US011844388B2

(12) United States Patent
Pearse-Danker

(10) Patent No.: US 11,844,388 B2
(45) Date of Patent: Dec. 19, 2023

(54) HOOD

(71) Applicant: Mark Pearse-Danker, Bruttig-Fankel (DE)

(72) Inventor: Mark Pearse-Danker, Bruttig-Fankel (DE)

( * ) Notice: Subject to any disclaimer, the term of this patent is extended or adjusted under 35 U.S.C. 154(b) by 0 days.

(21) Appl. No.: 17/477,626

(22) Filed: Sep. 17, 2021

(65) Prior Publication Data

US 2023/0091741 A1 Mar. 23, 2023

(51) Int. Cl.
*A42B 1/045* (2021.01)

(52) U.S. Cl.
CPC ..... *A42B 1/045* (2013.01)

(58) Field of Classification Search
CPC ..... A42B 1/208; A42B 1/045; A42B 1/048; A42B 1/006
See application file for complete search history.

(56) References Cited

U.S. PATENT DOCUMENTS 1,167,379 A * 1/1916 Buckman ..... A42B 1/045 2/203
1,316,778 A * 9/1919 Ensten ..... A42B 1/045 2/172
1,508,702 A * 9/1924 Lark ..... A42B 1/045 2/204
1,879,104 A * 9/1932 Cooper ..... A42B 1/06 2/6.2
2,039,478 A * 5/1936 Ensten ..... A42B 1/045 2/205
2,064,032 A * 12/1936 Roberts ..... A42B 1/045 D29/106
2,131,248 A * 9/1938 Astrove ..... A42B 1/045 2/84
2,199,427 A * 5/1940 Dohen ..... A42B 1/045 2/204
2,241,694 A * 5/1941 Astrove ..... A42B 1/045 2/84
2,313,458 A * 3/1943 Irving ..... A42B 1/045 2/84
2,372,040 A * 3/1945 Wolfe ..... A42B 1/045 D2/866
2,686,317 A * 8/1954 Michaelis ..... A42B 1/045 2/205
2,694,812 A * 11/1954 Neuburger ..... A42B 1/045 2/202

(Continued)

FOREIGN PATENT DOCUMENTS

EP 3430925 1/2019

*Primary Examiner* — Richale L Quinn

(57) ABSTRACT

The invention relates to a multifunctional garment comprising a fabric element having at least two plies or layers, with said two plies being attached to each other along their respective edges and the connection being openable along at least one edge, wherein at least two cords extend from the edge along which opening of the connection is possible, and the cords run through one or more clamps so that an adjustment of the length of the cords between the clamps and the edge can be brought about, and wherein along the edge of the fabric element opposite to the edge along which an opening of the connection is possible, a zipper is arranged that can be closed from the middle of the edge outwardly. The garment may particularly be used as a hood, shoulder bag, neck warmer or shoulder cape.

14 Claims, 5 Drawing Sheets

(56) References Cited

U.S. PATENT DOCUMENTS 2,708,273 A * 5/1955 Bonaventura ..... A42B 1/041 D2/866
2,735,283 A * 2/1956 Schuessler ..... A42B 1/045 2/202
3,014,221 A * 12/1961 Brunetto ..... A42B 1/045 2/205
3,275,106 A * 9/1966 Rush ..... A42B 1/045 383/4
3,376,581 A * 4/1968 Gettinger ..... A42B 1/16 2/209.11
3,460,163 A * 8/1969 Erbb ..... A42B 1/045 2/204
3,505,681 A * 4/1970 Israel ..... A41D 13/00 2/84
3,818,158 A * 6/1974 Nakanishi ..... A41D 15/04 2/202
4,031,567 A * 6/1977 Planck ..... A42B 1/0186 2/204
4,057,854 A 11/1977 Phelps, Sr.
4,110,846 A * 9/1978 Hernandez ..... A41D 23/00 2/203
4,573,217 A * 3/1986 Reed ..... A62B 17/04 2/205
5,016,287 A * 5/1991 Harris ..... A62B 17/04 2/205
5,212,837 A * 5/1993 Gose ..... A42B 3/105 2/916
5,303,427 A * 4/1994 Fishbaine ..... A45C 9/00 2/200.1
RE35,193 E * 4/1996 Shifrin ..... A42B 3/00 224/660
5,694,647 A * 12/1997 Crickmore ..... A42B 1/0187 2/172
5,790,986 A * 8/1998 Hall ..... A42B 1/0186 2/172
5,960,478 A * 10/1999 Sivret ..... A42B 1/046 2/202
6,006,360 A * 12/1999 Reed ..... A42B 1/045 2/5
6,237,154 B1 * 5/2001 Reuven ..... A42B 1/008 2/171.2
6,341,381 B1 * 1/2002 Rink, Jr. ..... A41D 3/08 2/202
6,425,138 B1 * 7/2002 Johnson ..... A42B 1/045 2/202
6,648,171 B2 * 11/2003 Rink, Jr. ..... A41D 3/08 221/26
6,789,266 B1 * 9/2004 Mills ..... A42B 1/045 2/202
8,161,575 B2 * 4/2012 Debrick ..... A41D 27/18 2/206
8,516,619 B2 * 8/2013 Absi ..... A42B 1/041 2/202
10,226,087 B2 * 3/2019 Held ..... G09F 21/02
10,945,519 B2 * 3/2021 Chacker ..... A41D 15/04
11,202,480 B2 * 12/2021 Brown ..... A42B 1/049
2003/0074717 A1 * 4/2003 Robinson ..... A42B 7/00 2/204
2006/0005297 A1 * 1/2006 Blecha ..... A42B 1/0181 2/207
2006/0010567 A1 * 1/2006 Vazquez ..... A42B 1/206 2/175.1
2006/0288468 A1 * 12/2006 Jorgenson ..... A42B 1/045 2/205
2007/0118971 A1 * 5/2007 Blecha ..... A42B 1/16 2/207
2009/0126078 A1 * 5/2009 Rashid ..... A42B 1/045 2/207
2013/0247275 A1 * 9/2013 Javad ..... A42B 1/16 2/203
2015/0201693 A1 * 7/2015 Donner ..... A42B 1/048 2/204
2017/0188645 A1 * 7/2017 Moreno, Jr. ..... A42B 1/045
2018/0310694 A1 * 11/2018 Yepremian ..... A41D 15/04
2019/0142094 A1 * 5/2019 Fermanian ..... A42B 1/06 2/204
2019/0159539 A1 * 5/2019 Pacheco ..... A47K 10/02
2020/0154795 A1 * 5/2020 Valster ..... A41D 3/005
2021/0045472 A1 * 2/2021 Abedinzadeh Kivi ..... A62B 18/025
2021/0298405 A1 * 9/2021 Yeh ..... A42B 1/0182
2022/0117379 A1 * 4/2022 Landry-Savard ..... A45D 44/08
2022/0346482 A1 * 11/2022 Hodgdon ..... A42B 1/045

* cited by examiner

HOOD

FIELD AND BACKGROUND OF THE INVENTION

The invention relates to a multifunctional garment capable of being used both as a hood and a bag.

Outdoor activities are very popular with a variety of people. It is very important in this context to have available good protective clothing to be able to guard against the effects of especially cold and wet weather. This applies in particular when spending time in areas where the weather is likely to change frequently. Moreover, it is particularly important for people who regularly engage in outdoor activities even in adverse weather conditions to guard themselves against the cold and wet, which is true for hikers, hunters, anglers, scouts, horseback riders, workers, wheelchair users or soldiers.

A wide range of clothing is already available for such activities, most of which is functional clothing or garment made of synthetic fibers, which is especially characterized by the fact that on the one hand it is water-repellent from the outside, thus preventing rain and precipitation to come into contact with the body, but on the other hand it causes sweat produced by the body to be transferred to the outside. It is to be noted however that garments available to date for outdoor activities mostly do not allow any multifunctional use, or at best only a limited one.

Commonly known as part of garments are hoods, some of which being designed so as to be separable from the garment itself. In particular, hoods of this type may in particular be attached to the garment, such as a jacket, by means of a zipper.

However, conventional hoods do not serve any other purpose and moreover are limited with respect to their adjustment options.

Proceeding from what is known from prior art, the objective to be achieved was to provide a multifunctional garment that serves as a hood but as far as its usability is concerned is more versatile than conventional hoods.

SUMMARY OF THE INVENTION

As proposed by the present invention, this objective is accomplished by a multifunctional garment comprising a fabric element having at least two plies, with the two plies being attached to each other along their respective edges and the attachment being openable along at least one edge, wherein at least two cords extend from the edge along which opening of the connection is possible, and the cords run through one or more clamps so that an adjustment of the length of the cords between the clamps and the edge can be brought about, and wherein along the edge of the fabric element opposite to the edge along which an opening of the connection is possible, a zipper is arranged that can be closed from the middle of the edge outwardly.

The garment proposed by the invention can be used not only as a hood, but in particular also as a bag the user may carry hanging over his or her shoulder. The garment is composed of a fabric element that as a rule comprises of two plies or layers. These are arranged on top of each other and attached along their relevant edges. Nevertheless, the fabric element can be opened along one edge, due to the fact that the attachment between the two plies is formed in such a way here that an opening becomes possible. In this manner, a bag is created the user may make use of for storage purposes. Moreover, since a cord extends from each edge, preferably from the end points of the edge along which the garment or, in this way of use, the bag can be opened, and the cords are brought together at the clamps provided for this purpose, this automatically provides a means of hanging the bag over the shoulder.

When it is spread out flat, the fabric element preferably has a substantially rectangular shape, although the edge forming out the bag opening has a concave curvature. The remaining edges, in particular the edges connecting the edge provided with the zipper to be closed from the middle outwards and the edge with the bag opening, may also be arranged to have a more or less pronounced curvature.

While, when used as a shoulder bag, the fabric element is essentially a flat object, said element being converted into an object that with respect to its inner space is adapted to suit the shape of the head so that it can then be used as a hood. Proceeding from the fabric element spread out flat as described hereinbefore, a zipper extending outward from the middle of the edge is arranged on the edge opposite the bag opening described previously. In other words, when the zipper is open, the slider is located in the middle of the edge and can be moved towards the end points of the edge when closing. In this manner, the end points of the edge are brought together resulting in forming out the upper side of a hood. Expediently, the zipper provided is of non-separable type. When arranged in the form of a hood, the described zipper extends along the top edge of the hood from the front to the back of the head. To facilitate the closing of the zipper, a loop can be attached to the slider, which the user can easily grasp.

At the opposite edge, which is the edge that forms the bag opening when the garment is used as a shoulder bag, the hood can be drawn together by moving the clamps fixed to the cords in the direction of the edge, in particular the end points of the edge. In this manner, the free length of the cords is shortened, i.e. the section that extends between the clamp and the edge. When worn as a hood, this is the area that will be arranged around the neck. Tightening the cords with the help of the clamps allows the garment to be appropriately narrowed so that it can be worn as a hood.

Advantageously, several loops are arranged along the circumference of the fabric element. The cords, moreover, are provided with toggles located at their free ends, meaning at the ends opposite the connections to the edge of the fabric element, said toggles being suitable for engagement with the loops arranged along the circumference of the fabric element. In this way, a wide range of possible garment arrangements are conceivable. In particular, when the garment is worn as a hood, the cords with their toggles can be passed through the loops with a view of drawing the hood together so as to be tighter or less tight. A less tight fit is often more comfortable, while, on the other hand, a tighter fit of the hood to the head will be preferable in high winds or storms.

Additionally, the loops in conjunction with the respective toggles enable the use of the garment as a neck guard or neck warmer. The garment can thus be arranged around the neck, for which purpose the edge that as a rule creates the bag opening when the garment is used as a shoulder bag is placed against the neck. Following this, the toggles can be drawn through the loops to achieve a fixation on the neck. In doing so, the user is free to individually adjust the width as desired to make the neck warmer fit more or less tightly.

Another alternative use is to wear the garment as a shoulder cape. For this purpose, the garment is placed around the shoulder in a way that makes it hanging down over the upper part of the back. In this case as well, the loops and toggles serve to adjust the way of wearing the garment.

The connection of the fabric element to be opened, namely the bag opening, is typically provided with a zipper, because it is particularly easy in this way to open and close the shoulder bag, as has been proven to be the case with other types of bags. This feature may in particular be a separable zipper. In this way, the zipper also serves to connect to another garment, in particular a jacket, cape, poncho or the like. In this respect, the zipper has a dual function, in that the simultaneous use of two rows of teeth serves to close the bag, and in addition, only a single row of teeth can be used to connect it with a respective row of teeth of another garment. The zipper that serves for connection to further components is advantageously overlapped by fabric in such a way that water is prevented from penetrating into the zipper itself.

In accordance with an especially preferred embodiment, the zipper is provided with at least three rows of teeth so that it is possible to connect the hood to another garment in differently oriented configurations. This is especially useful when attaching the hood to a garment provided with an interchangeable front and back portion.

The other item of garment to which the garment described here can be attached may, for example, consists of a garment having a textile fabric structure provided with a central opening for the head of the wearer and two further openings for the arms of the wearer, with at least two bands being attached to the textile fabric at attachment points and each band being assigned an opening in the textile fabric, with the attachment point and the opening of each band being arranged one behind the other in the longitudinal direction, and with the textile fabric being provided with an at least partially circumferential zipper, which enables the garment to be brought into a sleeping bag form by closing the zipper. Such a garment can be used in many ways. On the one hand, it is possible to drape the garment around oneself and close it in the area of the neck and/or chest, for example, making use of a toggle fastener, buttons and/or zippers, so that in this manner a cape can be created. Another option is to wear the garment as a poncho. For this purpose, the head is put through the opening thus provided, and the arms, likewise, to be passed through two other openings, which are provided for this use. The two other openings for the arms are preferably situated on a line orthogonal to the longitudinal axis of the garment. Wearing the garment as a poncho is particularly indicated in rainy weather, while wearing as a cape is typically considered in dry weather conditions. Therefore, the invention also relates to a combination of the multi-functional garment as described hereinbefore, which in particular can also be used as a hood, with the further garment, which can serve as a cape or poncho.

Preferably, the two cords run through two clamps. Each cord thus extends from the point of connection with the fabric element through the first clamp and the second clamp up to the end provided with a toggle. The clamps serve to enable both cords to pass through, which means, the cords are brought together at the respective clamps, and pulling the clamps tight enables the garment to be simultaneously tightened on both sides. Within the meaning of the present invention, clamps are understood to be objects through which two cords can be passed and which are arranged on the cords so as to be displaceable in longitudinal direction.

In particular, the clamps in this context are cord stoppers. Cord stoppers, also called cord locks, are clamps by means of which cords can be secured and held in place. To achieve this, the cords are pulled through a common or a separate opening and arrested in place at the desired location by a spring-loaded pin. To release the cord, the pin is pressed down manually. Such cord stoppers are widely used for backpacks.

Along the lateral edges connecting the edge with the zipper to be closed from the center outward and the edge with the bag opening, the cords can each be guided at least partially through a tunnel running along the edges, for example, guided through tunnels over approximately half the edge in each case, but be allowed to run freely approximately from the middle of the edge. In other words, the cords extend from the corners of the fabric element, where the edges with the tunnel meet the edge with zipper to be closed in outward direction, through the tunnel and exit from the tunnel about halfway along the lateral edges. This has turned out to be advantageous when adjusting the hood so as to be wider or narrower. Moreover, by pulling the cords in this way, the hood can appropriately be shaped to form a kind of visor or shield in the forehead area, which is particularly useful for people who wear glasses.

The number of loops arranged along the fabric element preferably ranges between 4 and 10, with the use of a total of 6 or 8 loops being particularly preferred. One loop may, for instance, be arranged in each of the corner points of the fabric element, and one or two further loops can be arranged on each of the fabric element edges, said loops being used to connect the edge with the outwardly closing zipper to the edge of the bag opening. This number of loops has proven to be particularly beneficial and sufficient to achieve a variety of adjustment options.

A zipper may as well be arranged at least partially along the edges of the fabric element connecting the edges with the outwardly closing zipper to the edge of the bag opening, the zipper in particular starting from the corners adjacent to the edge of the bag opening. As a rule, loops are arranged here; the zipper can extend, for instance, to the next loop on this side. At each of the two relevant edges, the halves of a zipper, that is one row of teeth of a separable zipper in each case, are arranged so as to be compatible with one another, which makes a (partial) closing possible in the neck and chin area when worn as a hood. The wearer in this way obtains additional protection against inclement weather, a particularly important factor in the areas of the neck that are sensitive to heat.

At least two connecting elements may be arranged on at least one surface side of the fabric element to enable optional connection with each other. It particularly makes sense to use the side that is on the outside when worn as a hood. In this way, the hood can be suitably adjusted so that it projects over the forehead to a greater or lesser extent. On the one hand, it may be desirable for the hood not to protrude too far beyond the forehead so as not to significantly restrict the field of vision. In this case, the two connecting elements may be joined together so as to tighten the hood slightly in the longitudinal direction. On the other hand, and especially in the event of inclement weather conditions, it may be desirable for the head to be more protected, in which case the hood is permitted to protrude further forward beyond the forehead, which is brought about by loosening the two matching connecting elements. Said connecting elements may in particular comprise a toggle as well as a loop matching the toggle.

The two plies or layers of the fabric element may consist of different materials, especially of different textile materials. In this case, a distinction can be made between the layer that is normally arranged on the outside when the garment is used as a hood, and the layer that is typically on the inside. For example, a soft wool or cotton fabric is advantageously employed for the inner layer, whereas a water-repellent fabric, for example, a synthetic fabric with a microporous membrane that is impermeable to water but permeable to water vapor is arranged as outer layer. Each of the two layers of the fabric element forming the sides of the bag when the garment is used as a bag, may in turn as well be composed of several individual layers consisting of different materials.

The cords provided in the garment proposed by the invention may be of different design. Within the meaning of the invention cords are also understood to be drawstrings, straps, ropes, flat belts, bands, etc. The cords are typically made of a textile material, but it is also conceivable, for example, to make them of leather.

It is also considered expedient to attach reflective strips to the inventive garment. In this way, this will significantly increase safety in the dark which is in particular important for cyclists, but also for pedestrians, horse riders, wheelchair users, etc.

As proposed by the invention, several garments can also be connected to each other via the zippers that serve for bag closure. This applies in particular if the zippers involved are separable zippers with possibly several rows of teeth. The same zippers which are used for the attachment of other garments such as jackets, coats, capes or ponchos thus also enable the connection of two garments that form part of the invention. In this case, one of the two garments for example can be worn as a hood, while the other is used as a shoulder cape which enables the entire head, neck, nape and shoulder area to be protected. The wearing style in this case is similar to a cowl hood (gugel), as it was worn as a medieval garment.

The fabric element of the inventive garment may, for example, have dimensions of about 30-80×20-60 cm, preferably 40-70×30-50 cm, particularly preferable approx. 55×45 cm. The dimensions indicated are to be understood as the lengths of the respective edges, taking into consideration that the edge along which the bag can be opened or closed may have a concave curvature. Also the other edges may be of more or less curved configuration.

Another way of putting the multifunctional garment provided by the invention to use is to fix it over a frame serving as a carrying structure, so that a backpack is created. The connecting elements of the multifunctional garment, especially the zippers, loops, cords, toggles, etc., serve to secure it to the carrying system.

The multifunctional garment is generally appropriate for people who frequently engage in outdoor activities, regardless of the prevailing weather conditions. Counted among these are, for example, hikers, hunters, anglers, scouts, equestrians, soldiers, wheelchair users, or workers.

The invention is now described in detail as follows with reference being made to the figures showing the respective embodiments. It is to be noted that the figures show preferred embodiment variants of the invention, with the invention itself not being limit thereto. To the extent it is technically expedient, the invention comprises, in particular, any optional combinations of the technical features that are stated in the claims or in the description as being relevant to the invention.

BRIEF DESCRIPTION OF THE SEVERAL VIEWS OF THE DRAWINGS

Elucidation of the invention is provided by the following figures where.

DESCRIPTION OF SPECIFIC EMBODIMENTS OF THE INVENTION

Figure 1:
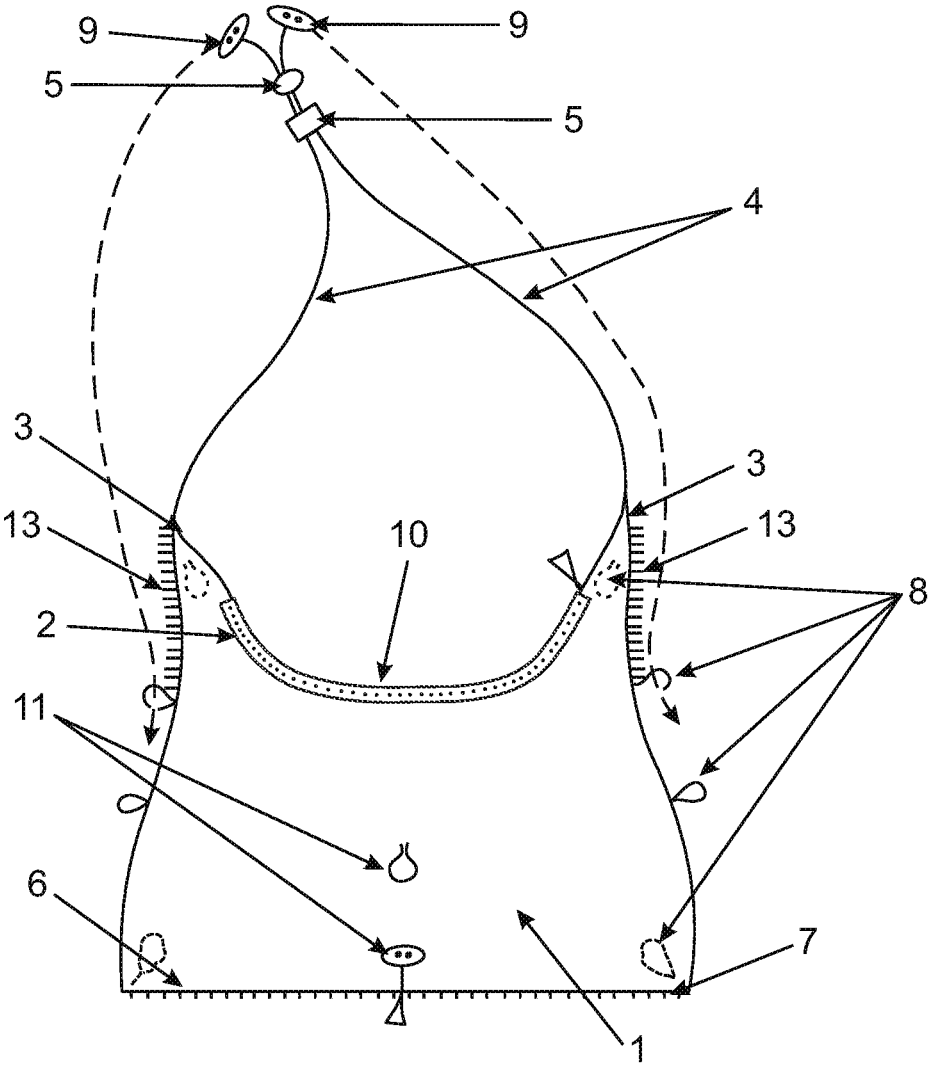
FIG. 1 shows the multifunctional garment according to the invention as a bag from the outside.

FIG. 1 illustrates the garment as proposed by the invention when used as a bag. The garment is composed of a fabric element that comprises of two plies or layers arranged one on top of the other. The fabric element 1 is provided with an edge 6 as well as an edge 2, the latter being the opening for the bag. While edge 6 is essentially straight, edge 2 forms a concave curvature for the bag opening. On the left and on the right side two more edges can be seen that connect edges 2 and 6.

On the edge 2 a zipper 10 is arranged by means of which the bag can be opened. In addition, a cord 4 starts out from each of the end points 3 of the edge 2 said cord being brought together with the cord 4 extending from the other end point 3 in two cord stoppers 5 arranged one behind the other. Each of the cords 4 terminates in a toggle 9.

Various loops 8, here eight in total, are arranged around the circumference of the fabric element 1. These are designed in such a way that they are adapted to the toggles 9, that is, the toggles 9 can be passed through the loops 8 as indicated in the figure by the dashed lines. In the illustration shown here, the bag can be hung over the shoulder making use of the cords 4. The length can be adjusted individually via the cord stoppers 5.

It is also evident from the figure that, on the outside of the bag which is typically a side made of a water-repellent material, there are two connecting elements 11 that are matched to each other. These connecting elements are a toggle and a loop that matches it. The respective meaning of the two is explained hereinafter when used as a hood.

Along the edge 6, which is located opposite to the edge 2 of the bag opening, zipper 10 is furthermore arranged, for which the slider is illustrated here in the middle of the edge 6. This is a non-divisible zipper 10 that can be closed from the inside to the outside. This is of significance when the garment is used as a hood as described hereinafter.

Along the lateral edges connecting edges 2 and 6, a row of teeth of a separable zipper 13 is arranged in each case between the loop arranged in the corner with edge 2 and the following loop. When the garment is used as a hood, the two rows of teeth can be more or less connected as required to open or close the opening in the neck and chin area. Here, the slider of the zipper as a rule starts from one of the two corners.

Figure 2:
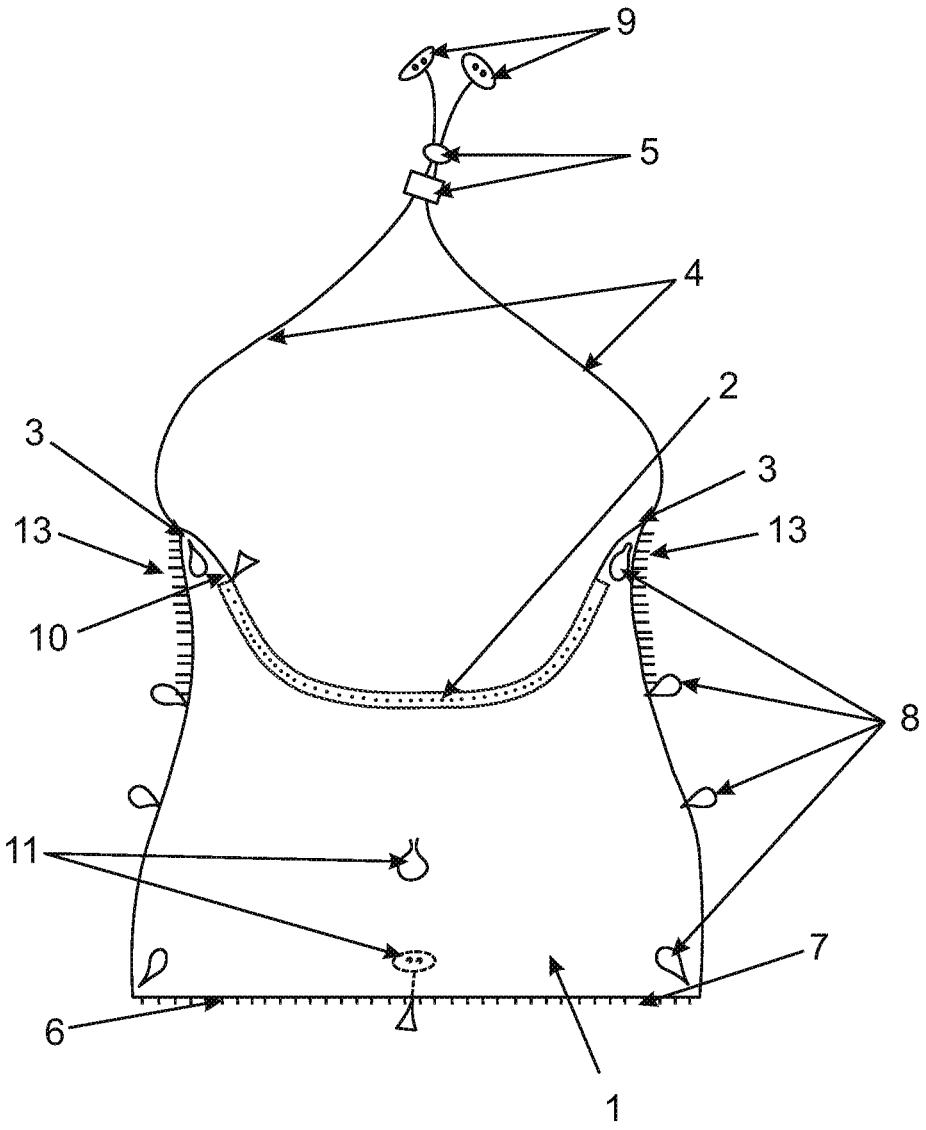
FIG. 2 shows the multifunctional garment according to the invention as a bag from the inside.

FIG. 2 illustrates the respective bag, however from the side typically worn inside. This may be a woolen material or cloth, for instance.

Figure 3:
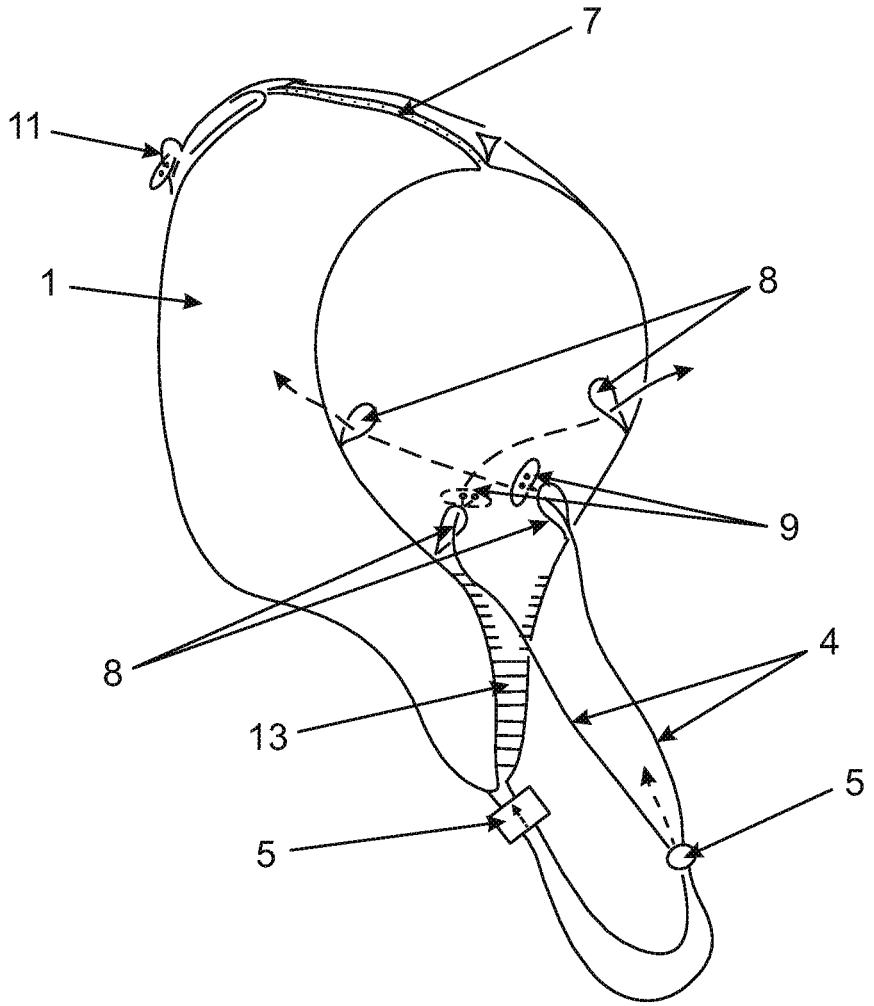
FIG. 3 depicts the multifunctional garment according to the invention as a hood.

FIG. 3 is a representation of the garment when used as a hood. In this representation, the zipper 7 has been closed, so that the upper edge of the hood is formed. Edge 2, which is the edge for the bag opening as described above, then automatically forms the area of the hood placed around the neck or on the nape of the neck. At this point, a connection arrangement with another garment may be provided, for example, with a jacket, a coat, a cloak/cape or a poncho.

The hood can be tightened or made wider as desired or needed via cord stoppers 5 and cords 4. Moreover, the cords 4 can be drawn through the loops 8, with toggles 9 making sure that cords 4 do not undesirably slip out of the loops 8 spontaneously. Making use of cords 4, loops 8, toggles 9 and cord stoppers 5 the hood is capable of being adjusted so as to be tighter or wider depending on individual requirements and weather conditions. The two connecting elements 11 can be joined together in a way that the toggle is passed through the respective loop with a view to shortening the hood at the top of the head. On the other hand, when the connecting elements 11 are disengaged the hood lengthens slightly at the top. To tighten the hood in the chin area, zipper 13 is closed to some extent. Suitable connecting means which are not shown here may also be provided on the inside, said means being matched to each other, for example a button and a buttonhole or snap fasteners.

Figure 4:
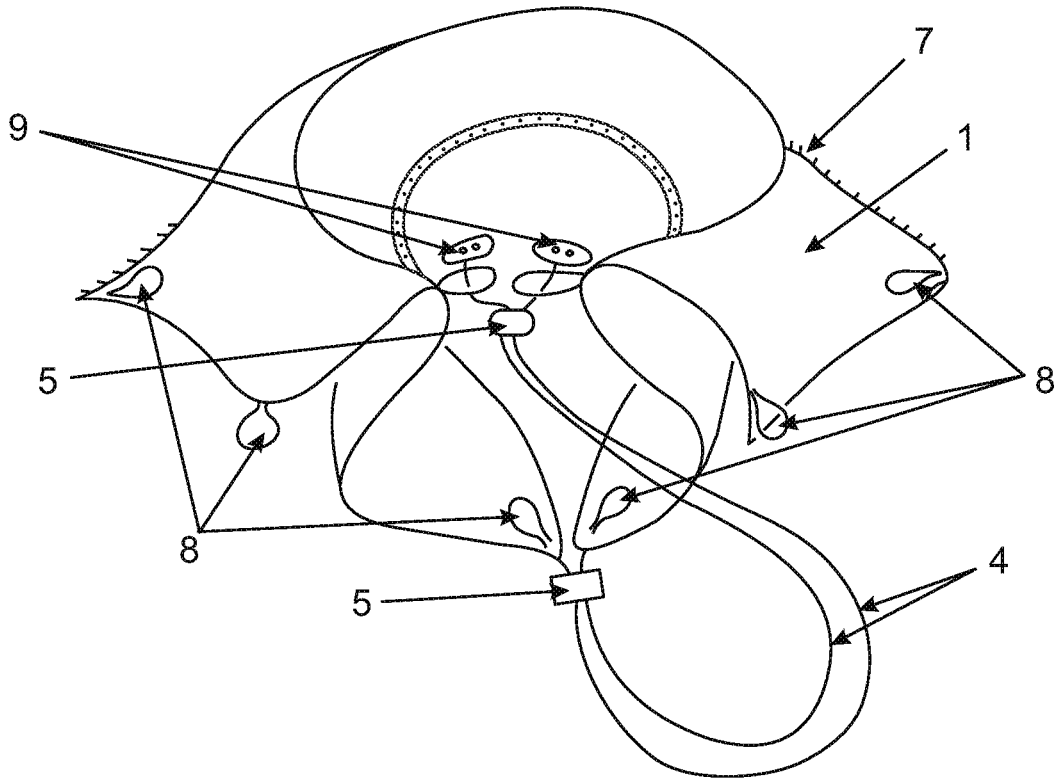
FIG. 4 illustrates the multifunctional garment according to the invention as neck warmer and FIG. 5 shows two combined multifunctional garments according to the invention as shoulder cape and hood.

The representation in FIG. 4 illustrates the use of the garment as a neck warmer that can be arranged around the neck. In this case, the fabric element 1 is placed around the neck with toggles 9 being passed through respective loops 8 to secure the fabric element 1 in the neck area. Via the cord stoppers 5, the users can adjust how tightly the fabric element 1 fits the neck and nape. Especially when (mountain) hiking in windy environments, using the garment in such a way can be useful.

Figure 5:
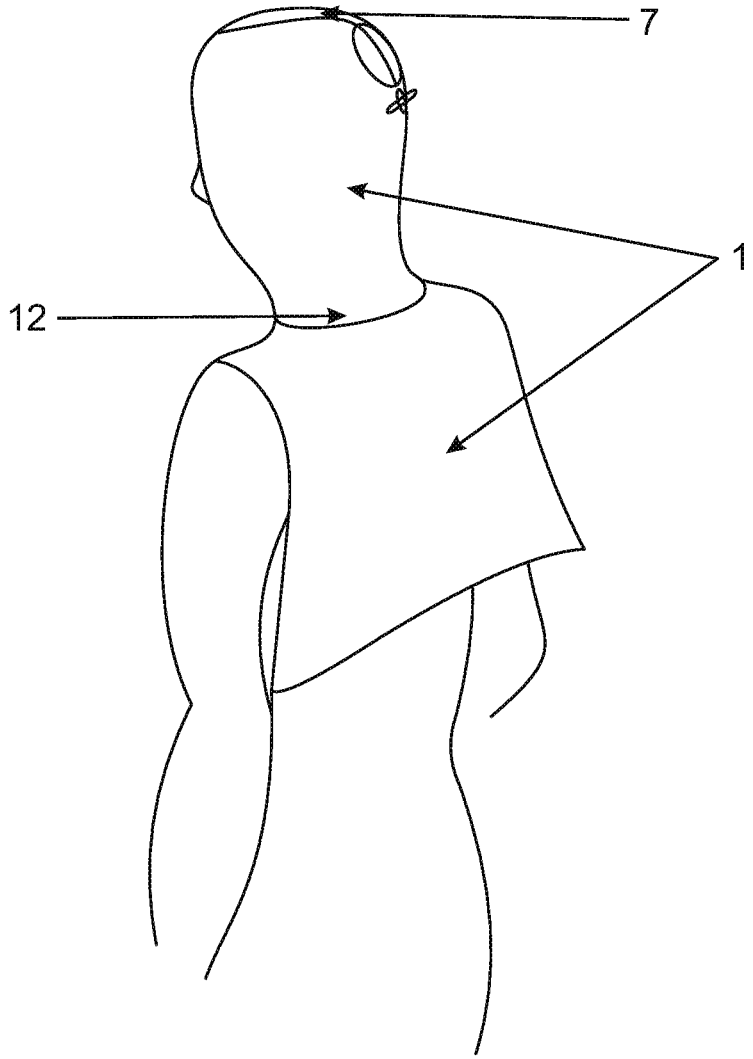

Finally, in FIG. 5 it is shown how two fabric elements 1 can be joined together. This connection is accomplished along a line 12 via the respective zippers 10, which otherwise also serve for bag closing. These zippers 10 may be designed as separable zippers with several rows of teeth, allowing two fabric elements 1 to be joined together. In the garment wearing mode illustrated here, one fabric element 1 serves as a hood, which is why the zipper 7 is closed, whereas the second fabric element 1 represents a shoulder cape.

What is claimed is:

1. A multifunctional garment comprising:

a fabric element having a straight edge, and a concaved curvature edge opposed to the straight edge;

a concaved curvature edge zipper arranged on the concaved curvature edge to open and close an opening formed between layers of the fabric element;

at least two cords each connected to an end point of the concaved curvature edge;

one or more clamps; and a straight edge zipper arranged to be closed from a middle of the straight edge outwardly;

wherein the cords run through the one or more clamps so that an adjustment of the length of the cords between the clamps and the concaved curvature edge can be brought about.

2. The multifunctional garment according to claim 1, further comprising a plurality of loops arranged along a circumference of the fabric element; wherein each of the cords has one of a plurality of toggles located at their exposed ends.

3. The multifunctional garment according to claim 1, wherein the fabric element having lateral edges between the straight edge and the concaved curvature edge; wherein each one of the lateral edges has a row of teeth of another zipper thereon.

4. The multifunctional garment according to claim 3, wherein the row of teeth is adapted to connect to a further garment using the another zipper.

5. The multifunctional garment according to claim 1, wherein the another zipper is adapted to connect the garment in differently oriented configurations.

6. The multifunctional garment according to claim 1, wherein the cords are secured and held in place by the one or more clamps.

7. The multifunctional garment according to claim 1, wherein the one or more damps having a pin adapted to be pressed down manually for releasing the cords.

8. The multifunctional garment according to claim 1, wherein the plurality of loops includes four to ten loops arranged along the circumference of the fabric element.

9. The multifunctional garment according to claim 8, wherein the plurality of loops includes six or eight loops are arranged along the circumference of the fabric element.

10. The multifunctional garment according to claim 1, further comprising at least two connecting elements arranged on at least one surface side of the fabric element, said connecting elements being connectable with one another.

11. The multifunctional garment according to claim 10, wherein the connecting elements comprise toggles and loops matched to one another.

12. The multifunctional garment according to claim 3, wherein a row of teeth on one of the lateral edges is matching a row of teeth on another of the lateral edges.

13. The multifunctional garment according to claim 1, wherein two layers of the fabric element are made of different materials.

14. The multifunctional garment according to claim 13, wherein the two layers of the fabric element are made of different textile materials.

* * * * *